US005826353A

United States Patent [19]

Woznicki

[11] Patent Number: 5,826,353

[45] **Date of Patent: *Oct. 27, 1998**

[54] CLOSURE FOR BOOT TONGUE

[75] Inventor: Clark D. Woznicki, Eau Claire, Wis.

[73] Assignee: Mason Shoe Manufacturing Co., Chippewa Falls, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 782,111

[22] Filed: Jan. 13, 1997

[51] Int. Cl.[6] ..... A43B 23/26

[52] U.S. Cl. ..... 36/54; 36/50.1

[58] Field of Search ..... 36/54, 50.1, 138, 36/109

[56] References Cited

U.S. PATENT DOCUMENTS 1,247,435 11/1917 McHannan .
4,377,913 3/1983 Stone .
4,442,613 4/1984 Dobbin .
4,550,511 11/1985 Gamm .
4,577,419 3/1986 Chassaing ..... 36/89
4,584,783 4/1986 Dobbin .
4,628,622 12/1986 McBarron .
4,958,447 9/1990 DuPree ..... 36/114 X
5,384,971 1/1995 Ferry ..... 36/4 X

*Primary Examiner*—Ted Kavanaugh
*Attorney, Agent, or Firm*—Merchant, Gould, Smith, Edell, Welter & Schmidt, P.A.

[57] ABSTRACT

A boot is shown having a tongue with oppositely disposed side margins, an upper extending above the ankle with oppositely disposed upper portions overlying the tongue margins, and with laces for selectively adjusting the fit of the upper portions over the tongue. Two sets of hook and loop fasteners are provided to interconnect the tongue and upper portions for holding the tongue in place during fitting of the boot. One set of hook and loop fasteners is attached to each side margin of the tongue and to the overlying upper portion of the boot.

4 Claims, 1 Drawing Sheet

CLOSURE FOR BOOT TONGUE

BACKGROUND OF THE INVENTION

This invention relates generally to improvements in method and apparatus for tying and holding a boot on the foot of a wearer, and more particularly relates to improved method and apparatus for holding the uppers in place over the tongue while the boot laces are being adjusted and tied.

Boots, which by definition have uppers extending over the ankle, are usually held in place by laces which extend between the uppers over the tongue. The laces are connected to either eyelets in or hooks on the edges of the uppers which overlie the opposite sides of the tongue. After the foot is inserted in the boot, the laces are tightened from the bottom and then tied at the top after they are properly adjusted. The laces are difficult to adjust properly because they are tightened from the bottom, and after the boot is entirely laced it is difficult to adjust the lacing to achieve proper fit. During this process, the tongue may move in relation to the edges of the uppers and the lacing may be too tight or too loose in spots because of the difficulty in both holding the uppers and tongue in place while tying the laces at the same time.

SUMMARY OF THE INVENTION

Because of the present invention, the person tying the laces can achieve a comfortable, secure fit. Full attention can be given to lacing the boot because the uppers and tongue are held securely in place during the process. Separate hook and loop fasteners are affixed to both edges of the tongue, preferably near its top end, and to the inside surfaces of the edges of the facing upper portions of the boot. After the foot is inserted into the boot, and before lacing is commenced, the hook and loop fasteners are connected to secure the uppers to the tongue to hold the uppers and tongue in place while the boot is being laced. Full attention can then be given to lacing the boot without being concerned about movements of the tongue or uppers of the boot. The hook and loop fasteners remain attached after the laces are tied to assist in retaining the boot on the foot.

DESCRIPTION OF THE PREFERRED EMBODIMENT

Figure 1:
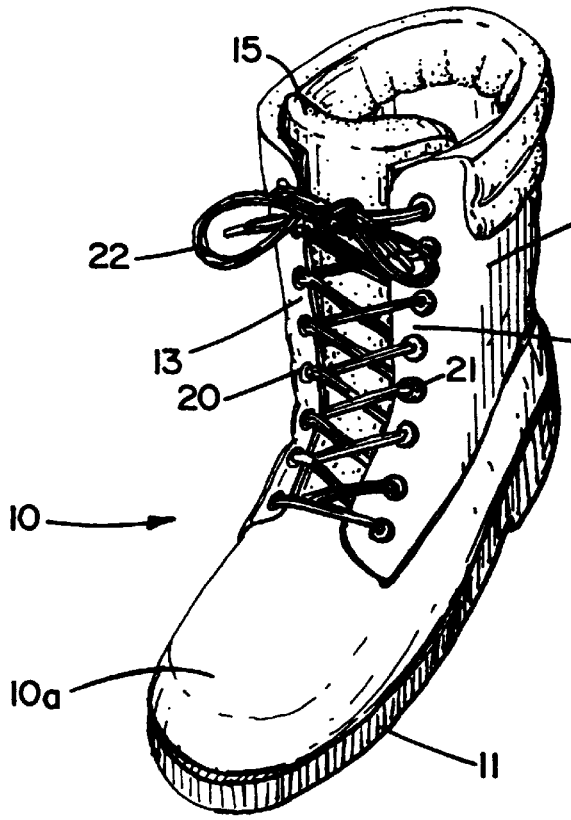
FIG. 1 is a view in perspective of a boot utilizing both a pair of hook and loop fasteners and laces to facilitate fitting and lacing of the boot.

Referring now to the drawings wherein like numerals are used throughout to identify like elements of the invention, there is shown in FIG. 1 a boot 10 having a sole 11 and an upper 12 having oppositely disposed upper portions 13, 14 overlying tongue 15. In the preferred embodiment, boot 10 is a leather boot but it could be made of rubber or other materials or combinations thereof. Tongue 15 has a free upper end and is connected at its lower end to a front upper portion 10*a* of boot 10. Tongue 15 further includes opposed side margins 15*a*, 15*b* underlying the edges of the upper portions 13, 14 generally along the full length thereof.

Two sets of hook and loop fasteners 16*a*, 16*b* and 17*a*, 17*b* are used to operatively interconnect the tongue 15 and upper portions 13, 14 for holding the tongue in place during fitting of the boot. In the preferred embodiment, the hook and loop fasteners each include a hook portion 16*b*, 17*b* each being attached to one of the side margins 15*a*, 15*b* of tongue 15. The other hook and loop fastener portions 16*a*, 17*a* are affixed to a respective upper portion 13, 14 overlying a side margin of the tongue, with the hook and loop portions 16*a*, 17*a* being selectively alignable and engageable with the oppositely disposed portion 16*b*, 17*b* to hold the tongue to the upper portions 13, 14.

Figure 2:
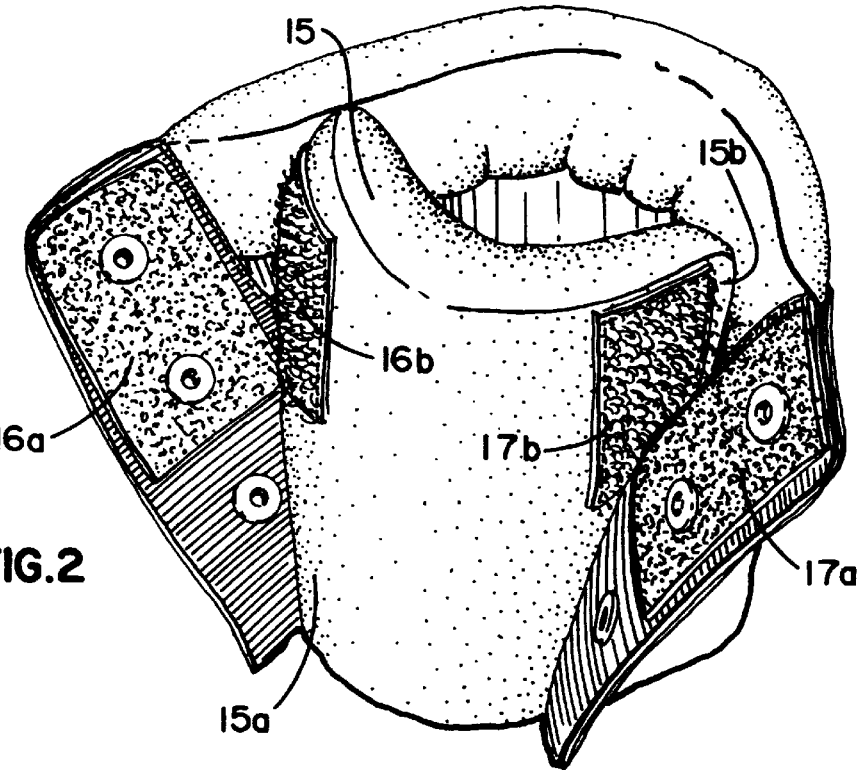
FIG. 2 is an enlarged, fragmentary view in perspective of an upper portion of the boot shown in FIG. 1, showing the positioning of the hook and loop fasteners.

As shown in FIG. 2, the loop portions 16*b*, 17*b* are attached to the tongue 15 and the hook portions 16*a*, 17*a* are attached to the uppers but those portions could be reversed without departing from the invention.

Boot 10 is also provided with separate securing means interconnecting the upper portions 13, 14 for selectively adjusting the fit of the upper portions over and on the tongue for the comfort of the wearer. In the preferred embodiment, boot 10 has a plurality of spaced eyelets 20, 21 located in the oppositely disposed edge portions of upper 12 over the tongue margins 15*a*, 15*b*. A fabric lace 22, which could also be leather, is interconnected through the eyelets 20, 21 in the usual fashion to permit the wearer to selectively adjust the fit of the upper portions. Although not shown in this embodiment, hooks could be used instead of or in combination with the eyelets 20, 21 to support the lacing. As best shown in FIG. 2, two of the eyelets at the top end, on both sides, extend through both the upper and the corresponding fastener portion 16*a*, 17*a*.

To utilize this invention, the wearer inserts his foot into the boot with the laces untied and loosened and with the hook and loop fasteners not fastened (as shown in FIG. 2). The uppers can thus be spread apart as far as necessary to comfortably insert the foot into the boot. After the foot is inserted in the boot, the upper edge portions 13, 14 are positioned over the tongue margins 15*a*, 15*b* to a position that is comfortable for the wearer and then the hook and loop fastener portions are pressed together to affix the side portions to the tongue as shown in FIG. 1. After that, the wearer can use both hands to adjust and tie the lacing to hold the boot in place on the foot. During the time that the boot is worn, both the securing means 22 and the hook and loop fasteners function to securely hold the boot in place on the foot and leg of the wearer.

The above specification, examples and data provide a complete description of the structure and use of the invention. Since many embodiments of the invention can be made without departing from the spirit and scope of the invention, the invention resides in the claims hereinafter appended.

I claim:

1. A boot, comprising:

(a) a tongue; an upper extending above the ankles said upper including oppositely disposed upper portions overlying the tongue;

(b) a pair of hook and loop fasteners operatively interconnecting the tongue and upper portions at upper ends thereof for holding the tongue in place securedly about the leg of a wearer above the ankle while the fit of the boot is secured with a lace after a foot has been inserted therein;

(c) the tongue including oppositely disposed side margins underlying the upper portions, each of said margins being selectively operatively interconnected to its overlying upper portion by one of said fasteners, wherein the tongue includes a lower fixed end and a free upper end and wherein said fasteners are located near the free upper end of the tongue;

(d) the hook and loop fasteners each including a hook portion and a loop portion, one portion being fixed to a side margin of the tongue, and the other portion being fixed to the upper portion overlying the side margin of the tongue, the hook and loop portions being selectively alignable and engageable to hold the tongue to both of the said upper portions; and (e) the lace interconnecting the upper portions for selectively adjusting the fit of the upper portions over and on the tongue for the comfort of the wearer, wherein the lace interconnects a plurality of spaced eyelets in said upper portions overlying the tongue in positions running from the lower fixed end to the free upper end, and wherein the lace secures the upper portions and tongue in place with a knot tied in the lace at a position above the ankle of the wearer.

2. A boot according to claim 1 wherein at least two eyelets extend through each of the other portions of said fasteners and through the upper portions to which said other portions are fixed.

3. A boot according to claim 1, wherein the tongue and the upper are constructed from leather.

4. A boot according to claim 1, wherein the tongue and the upper are constructed from rubber.

* * * * *